US005929170A

United States Patent [19]

Kawabata et al.

[11] Patent Number: 5,929,170

[45] Date of Patent: Jul. 27, 1999

[54] GOLF BALL

[75] Inventors: Hiroshi Kawabata; Yasuhiro Fukui, both of Kagawa-ken; Taro Izawa, Takamatsu, all of Japan

[73] Assignee: Kasco Corporation, Kagawa-ken, Japan

[21] Appl. No.: 08/921,562

[22] Filed: Sep. 2, 1997

[30] Foreign Application Priority Data

Sep. 13, 1996 [JP] Japan ..... 8-243769

[51] Int. Cl.[6] ..... A63B 37/12

[52] U.S. Cl. ..... 525/221; 525/196; 525/201; 473/378; 473/385

[58] Field of Search ..... 525/196, 201, 525/221; 473/378, 385

[56] References Cited

U.S. PATENT DOCUMENTS

| | | | |
|---|---|---|---|
| 4,884,814 | 12/1989 | Sullivan . | |
| 5,120,791 | 6/1992 | Sullivan . | |
| 5,415,937 | 5/1995 | Cadorniga | 525/196 |

FOREIGN PATENT DOCUMENTS

| | | |
|---|---|---|
| 0 582 487 | 2/1994 | European Pat. Off. . |
| 5-345051 | 12/1993 | Japan . |
| 6-313075 | 11/1994 | Japan . |
| 2 277 932 | 11/1994 | United Kingdom . |

OTHER PUBLICATIONS

Derwent Abstracts, AN 94–039728, JP 05 345051, Dec. 27, 1993.

*Primary Examiner*—David Buttner
*Attorney, Agent, or Firm*—Oblon, Spivak, McClelland, Maier & Neustadt, P.C.

[57] ABSTRACT

Disclosed is a golf ball comprising a core covered with a cover, wherein the cover is formed of a resin composition containing, as a major component, a mixture composed of (A) an ionomer resin of lithium salt of ethylene-(meta) acrylic acid copolymer, (B) an ionomer resin of bivalent metal salt of ethylene-(meta)acrylic acid ester-(meta)acrylic acid terpolymer, and (C) a partially saponified resin of ethylene-(meta)acrylic acid ester copolymer.

6 Claims, No Drawings

GOLF BALL

BACKGROUND OF THE INVENTION

1. Field of the Invention

The present invention relates to a golf ball which makes it possible to obtain a soft hitting feeling and a sufficient carry. In particular, the present invention relates to a golf ball comprising a cover composed of a base material containing an ionomer resin, which provides a soft hitting feeling, which is satisfactory in resilience to obtain a sufficient carry, and which hardly tends to suffer scratches on its cover surface.

2. Description of the Related Art

Ionomer resins of metal salt of ethylene-(meth)acrylic acid copolymer have been hitherto widely used as a material for a cover of a golf ball because they are advantageous and excellent in resilience and durability. However, the golf ball based on the use of such an ionomer resin as a material for its cover has a hard hitting feeling. Therefore, it has been tried to improve this drawback.

In order to soften the cover and obtain a soft hitting feeling, for example, it has been suggested to use, as a material for a cover, a mixture of an ionomer resin of sodium salt or zinc salt of ethylene-(meth)acrylic acid copolymer and a soft ionomer resin of sodium salt or zinc salt of ethylene-(meth)acrylic acid ester-(meth)acrylic acid terpolymer (see U.S. Pat. Nos. 4,884,814 and 5,120,791).

Such a suggested golf ball has a soft hitting feeling, however, it tends to undergo decrease in resilience of the cover and provide an inferior carry, as a result of its softened cover.

In order to soften the cover while maintaining the resilience of the cover, it has been suggested to use, as a material for a cover, a mixture of an ionomer resin of metal salt of ethylene-(meth)acrylic acid copolymer and a partially saponified resin of ethylene-unsaturated carboxylic acid ester copolymer (see Japanese Laid-Open Patent Publication Nos. 5-345051 and 6-313075). However, compatibility is not sufficient between the ionomer resin of metal salt of ethylene-(meth)acrylic acid copolymer and the partially saponified resin of ethylene-unsaturated carboxylic acid ester copolymer. For this reason, when the partially saponified resin of ethylene-unsaturated carboxylic acid ester copolymer is mixed in an excessive ratio, a problem arises in that the cover surface tends to suffer scratches when such a golf ball is hit with a golf club.

SUMMARY OF THE INVENTION

A general object of the present invention is to provide a golf ball based on the use of an ionomer resin, which gives a soft hitting feeling, which is satisfactory in resilience, and which hardly tends to suffer scratches on its cover surface, while avoiding deterioration of carry which would be otherwise caused as a result of decrease in resilience of its cover if it is intended to soften its cover and obtain a soft hitting feeling, and while avoiding the tendency of occurrence of scratches on its cover surface which would be otherwise caused if it is intended to soften its cover while maintaining the resilience of the cover.

The present invention lies in a golf ball comprising a core covered with a cover, wherein the cover is formed of a resin composition containing, as a major component, a mixture composed of (A) an ionomer resin of lithium salt of ethylene-(meth)acrylic acid copolymer, (B) an ionomer resin of bivalent metal salt of ethylene-(meth)acrylic acid ester-(meth)acrylic acid terpolymer, and (C) a partially saponified resin of ethylene-(meth)acrylic acid ester copolymer. In a preferred embodiment, assuming that the mixture is 100% by weight, the resins are mixed in a ratio within a range of 10 to 75% by weight of the ionomer resin (A), 10 to 88% by weight of the ionomer resin (B), and 2 to 30% by weight of the partially saponified resin (C). In another preferred embodiment, the ionomer resin (B) is an ionomer resin selected from the group consisting of an ionomer resin of zinc salt, an ionomer resin of magnesium salt, and an ionomer resin of calcium salt. In still another embodiment, the ionomer resin (B) contains an ionomer resin of magnesium salt.

As described above, a golf ball has been suggested, in which a cover is formed of a mixture of a so-called hard ionomer resin and a so-called soft ionomer resin. However, such a golf ball tends to give an inferior carry. On the other hand, it has been also attempted to provide a golf ball by mixing a partially saponified resin of ethylene-(meth)acrylic acid ester copolymer, in place of a soft ionomer resin. However, such a golf ball involves problems in that the durability is deteriorated, and splits or splinters tend to occur, because such a partially saponified resin is insufficient in compatibility with a hard ionomer resin.

The golf ball of the present invention dissolves the foregoing problems. Namely, the golf ball of the present invention has its cover which is formed of the resin composition containing, as the major component, the mixture composed of the ionomer resin (A) of lithium salt of ethylene-(meth)acrylic acid copolymer, the ionomer resin (B) of bivalent metal salt of ethylene-(meth)acrylic acid ester-(meth)acrylic acid terpolymer, and the partially saponified resin (C) of ethylene-(meth)acrylic acid ester copolymer. In general, the ionomer resin is prepared by neutralizing, with metal ion, a copolymer of ethylene and acrylic acid (ester) or methacrylic acid (ester). However, it is known that the physical properties of the ionomer resin changes depending of the content of (meth)acrylic acid and the type of metal ion. The present invention adopts, as a constitutive component of the cover of the golf ball, the ionomer resin of bivalent metal salt of ethylene-(meth) acrylic acid ester-(meth) acrylic acid terpolymer, especially preferably the jonomer resin of magnesium salt, wherein the other components to be mixed with the foregoing component are specified. Thus the present invention has succeeded in dissolving the problems described above.

In this specification, the term "(meth)acrylic acid" is used to express a concept which broadly includes acrylic acid, analogs thereof, and polymers of acrylic acid and analogs thereof. The term is used, for example, to indicate acrylic or methacrylic acid or the both. Therefore, in the embodiments of the present invention, (meth)acrylic acid may be acrylic acid or methacrylic acid. Accordingly, in this specification, the term "(meth)acrylic acid" is typically used to indicate acrylic acid and/or methacrylic acid.

The above and other objects, features, and advantages of the present invention will become more apparent from the following description in which a preferred embodiment of the present invention is shown by way of illustrative example.

DESCRIPTION OF THE PREFERRED EMBODIMENTS

The present invention will be explained in detail below.

(1) Ionomer Resin (A) of Lithium Salt of Ethylene-(meth) acrylic Acid Copolymer

In the present invention, the jonomer resin (A) of lithium salt of ethylene-(meth)acrylic acid copolymer is a resin or a mixture thereof obtained by neutralizing a part of carboxyl group of ethylene-(meth)acrylic acid copolymer with lithium ion. The ionomer resin (A) has a property of high resilience as compared with conventional ionomer resins of sodium salt or zinc salt of ethylene-(meth)acrylic acid copolymer. Those usable as the ionomer resin (A) of lithium salt of ethylene-(meth)acrylic acid copolymer include, for example, resins commercially available as Surlyn 7930 and Surlyn 7940 produced by E. I. du Pont de Nemours in the United States.

The ionomer resin (A) of lithium salt of ethylene-(meth) acrylic acid copolymer used in the present invention usually has a content of (meth)acrylic acid of 10 to 25% by weight and an ion neutralization degree of not less than 10 mole %, having physical properties of a Shore D hardness of not less than 60 and a flexural rigidity of 300 to 500 MPa.

(2) Ionomer Resin (B) of Bivalent Metal Salt of Ethylene-(meth)acrylic Acid Ester-(meth)acrylic Acid Terpolymer The ionomer resin (B) of bivalent metal salt of ethylene-(meth)acrylic acid ester-(meth)acrylic acid terpolymer is a resin or a mixture thereof obtained by neutralizing a part of carboxyl group of ethylene-(meth)acrylic acid ester-(meth) acrylic acid terpolymer with bivalent metal ion. Those usable as the (meth)acrylic acid ester of the ethylene-(meth) acrylic acid ester-(meth)acrylic acid terpolymer include, for example, methyl, ethyl, propyl, n-butyl, and isobutyl esters of acrylic acid or methacrylic acid. Those usable as the bivalent metal ion for neutralizing the part of carboxyl group of ethylene-(meth)acrylic acid ester-(meta)acrylic acid terpolymer include, for example, ions of zinc, magnesium, and calcium. Among these ion, magnesium ion is preferably used. The resin obtained by neutralization with magnesium ion is exemplified by Surlyn AD 8542 produced by E. I. du Pont de Nemours in the United States. The reason whey such an ionomer resin (B) is mixed is that an obtained cover has excellent durability against hitting.

In a preferred embodiment, the ionomer resin (B) of bivalent metal salt of ethylene-(meth)acrylic acid ester-(meth)acrylic acid terpolymer usually has a content of (meth)acrylic acid ester of 10 to 40% by weight, a content of (meth)acrylic acid of 2 to 20% by weight, and an ion neutralization degree of not less than 10mole %, having physical properties of a Shore D hardness of 20 to 50 and a flexural rigidity of 10 to 120 MPa.

(3) Partially Saponified Resin (C) of Ethylene-(meth)acrylic Acid Ester Copolymer The partially saponified resin (C) of ethylene-(meth) acrylic acid ester copolymer is a product or a mixture thereof obtained by saponifying a part of ester component of ethylene-(meth)acrylic acid ester copolymer with caustic alkali. The resin (C) includes, for example, saponified products or mixtures thereof obtained with sodium, lithium, and potassium. The (meth)acrylic acid ester of the ethylene-(meth)acrylic acid ester copolymer includes those equivalent to the (meth)acrylic acid ester of the ethylene-(meth) acrylic acid ester-(meth)acrylic acid terpolymer of the ionomer resin (B).

Partially saponified resin (C) of ethylene-(meth)acrylic acid ester copolymer is exemplified by SA420 produced by Du Pont-Mitui Polychemical.

The partially saponified resin (C) serves to soften the cover in the same manner as the ionomer resin (B). However, the reason why the resin (C) is mixed is that the obtained cover has high resilience as compared with those obtained by softening the cover with only the ionomer resin (B).

The partially saponified resin (C) of ethylene-(meth) acrylic acid ester copolymer usually has a content of (meth) acrylic acid ester of 15 to 50% by weight, and a saponification degree of 5 to 50 mole %. Preferably, the resin (C) has a content of (meth)acrylic acid ester of 20 to 40% by weight, and a saponification degree of 10 to 30 mole %.

(4) Mixture of Ionomer Resin (A), Ionomer Resin (B), and Partially Saponified Resin (C)

In the present invention, assuming that the mixture is 100% by weight, the ionomer resin (A), the ionomer resin (B), and the partially saponified resin (C) are usually mixed in a ratio within a range of 10 to 75% by weight of the ionomer resin (A), 10 to 88% by weight of the ionomer resin (B), and 2 to 30% by weight of the partially saponified resin (C). Especially preferably, the resins are mixed in a ratio within a range of 20 to 70% by weight of the ionomer resin (A), 20 to 78% by weight of the ionomer resin (B), and 2 to 25% by weight of the partially saponified resin (C). When the cover is produced with a base material of a mixture in which the ionomer resin (A), the ionomer resin (B), and the partially saponified resin (C) are mixed in the ratio as described above, the cover can be softened while maintaining the resilience of the cover. If the ionomer resin (A) is mixed in an excessive ratio, the cover is not softened. If the ionomer resin (A) is mixed in a smaller ratio, the resilience of the cover is deteriorated. If the partially saponified resin (C) is mixed in an excessive ratio, the cover surface tends to suffer scratches, and the deficiency in appearance is apt to occur.

The mixture of the ionomer resin (A), the ionomer resin (B), and the partially saponified resin (C) is generally produced by melting and mixing the resins by using, for example, a Banbury mixer or an extruder for thermoplastic resins. However, it is possible to mix polymers other than the ionomer resin (A), the ionomer resin (B), and the partially saponified resin (C), within a range in which the effect of the present invention is not deteriorated. It is also possible to mix additives such as colorants, fluorescent whiteners, antioxidants, ultraviolet-absorbing agents, ultraviolet stabilizers, and dispersing agents, if necessary.

(5) Golf Ball Comprising Core Covered with Cover

The golf ball of the present invention is produced by covering a core with the cover described above. Either solid (molded) cores or wound (yarn-wound) cores may be used as the core of the golf ball of the present invention. Any known method may be used, for example, to produce the core, cover the core with the cover, and produce the golf ball.

The present invention will be more specifically explained with reference to Examples described below. However, the present invention is not limited to the following Examples.

Examples 1 to 6

A rubber composition having a composition shown in Table 1 was heated, pressurized, and molded in a mold for a core to produce solid cores each having a diameter of 38.3 mm.

TABLE 1

| Composition | Parts by weight |
|---|---|
| cis-1, 4-Polybutadiene | 100 |
| Zinc acrylate | 29 |
| Zinc oxide | 23 |

TABLE 1-continued

| Composition | Parts by weight |
|---|---|
| Anti-aging agent | 0.5 |
| Organic peroxide | 3 |

Next, the solid core was covered with each of covering compositions of Examples 1 to 6 having compositions shown in Table 2, by means of injection molding to form a cover, followed by applying polishing and painting thereto. Thus respective two-piece solid golf balls each having a diameter of 42.7 mm were obtained. Characteristics of the obtained respective golf balls of Examples 1 to 6 were measured and evaluated. Results are shown in Table 2.

Comparative Examples 1 to 4

The rubber composition having the composition shown in Table 1 was heated, pressurized, and molded in a mold for a core to produce solid cores each having a diameter of 38.3

Next, the solid core was covered with each of covering compositions of Comparative Examples 1 to 4 having compositions shown in Table 2, by means of injection molding to form a cover, followed by applying polishing and painting thereto. Thus respective two-piece solid golf balls each having a diameter of 42.7 mm were obtained. Characteristics of the obtained respective golf balls of Comparative Examples 1 to 4 were measured and evaluated. Results are shown in Table 2.

TABLE 2

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Composition for cover | | | | | | | | | | |
| Surlyn 7930 *1 | 70 | 55 | 50 | 60 | 35 | 20 | | | 85 | 5 |
| Surlyn AD 8542 *2 | 25 | 35 | 25 | 30 | 22 | 42 | | | 5 | 57 |
| Himilan AM 7316 *3 | | | | 5 | 35 | 35 | 35 | | | 35 |
| SA 420 *4 | 5 | 10 | 25 | 5 | 8 | 3 | | 35 | 10 | 3 |
| Himilan 1605 *5 | | | | | | | 32.5 | 32.5 | | |
| Himilan 1706 *6 | | | | | | | 32.5 | 32.5 | | |
| Ball | | | | | | | | | | |
| Hardness of cover (Shore D) | 69 | 67 | 62 | 67 | 61 | 55 | 67 | 61 | 71 | 50 |
| Wear mass (mg) *7 | 8 | 10 | 11 | 10 | 10 | 9 | 28 | 40 | 18 | 11 |
| Resilience *8 | 101.3 | 101.0 | 100.3 | 101.1 | 99.8 | 99.4 | 100 | 99.8 | 101.4 | 98.4 |
| Hitting feeling *9 | ○ | ○ | ◎ | ○ | ◎ | ◎ | ○ | ◎ | X | X |
| Evaluation for appearance *10 | ○ | ○ | ○ | ○ | ○ | ○ | ○ | X | ○ | ○ |

Details of items affixed with the symbol (*), of the items shown in Table 2 are as follows.

*1 (Surlyn 7930): trade name, ionomer resin of lithium salt of ethylene-methacrylic acid copolymer (methacrylic acid content: 15% by weight) produced by E. I. du Pont de Nemours in the United States, Shore D hardness: 65, flexural rigidity: 336 MPa;

*2 (Surlyn AD 8542): trade name, ionomer resin of magnesium salt of ethylene-isobutyl acrylate-methacrylic acid terpolymer (isobutyl acrylate content: 23% by weight, methacrylic acid content: 9% by weight) produced by E. I. du Pont de Nemours in the United States, Shore D hardness: 44, flexural rigidity: 35 MPa;

*3 (Himilan AM 7316): trade name, ionomer resin of zinc salt of ethylene-isobutyl acrylate-methacrylic acid terpolymer (isobutyl acrylate content: 20% by weight, methacrylic acid content: 8% by weight) produced by Du Pont-Mitsui Polychemical, Shore D hardness: 28, flexural rigidity: 24 MPa;

*4 (SA 420): trade name, 20 mole % sodium ion partially saponified resin of ethylene-ethyl acrylate copolymer (ethyl acrylate content: 25% by weight) produced by Du Pont-Mitsui Polychemical, Shore D hardness: 28, flexural rigidity: 20 MPa;

*5 (Himilan 1605): trade name, ionomer resin of sodium salt of ethylene-methacrylic acid copolymer produced by Du Pont-Mitsui Polychemical, Shore D hardness: 65, flexural rigidity: 280 MPa;

*6 (Himilan 1706): trade name, ionomer resin of zinc salt of ethylene-methacrylic acid copolymer produced by Du Pont-Mitsui Polychemical, Shore D hardness: 64, flexural rigidity: 244 MPa;

*7 (Wear mass): test pieces were prepared by molding the respective compositions for the cover, and the wear test was performed in accordance with JIS-K7204;

*8 (Resilience): initial velocity of the golf ball measured by striking the ball by using a swing robot with a wood No. 1 club, represented as an index assuming that a value for Comparative Example 1 was 100;

*9 (Hitting feeling): evaluated by practically hitting the ball by an expert golfer (man); double circle: extremely good, circle: good, cross: bad;

*10 (Evaluation for appearance): evaluated by practically hitting the ball by an expert golfer (man); circle: good with little scratches, cross: bad with many scratches.

As shown in Table 2, high resilience was obtained in Examples 1, 2, and 4 as compared with Comparative Example 1 based on the use of the mixture composed of the ionomer resin (Himilan 1605) of sodium salt of ethylene-methacrylic acid copolymer, the ionomer resin (Himilan 1706) of zinc salt of ethylene-methacrylic acid copolymer, and the ionomer resin (Himilan AM 7316) of zinc salt of ethylene-isobutyl acrylate-methacrylic acid terpolymer. In Examples 3, 5, and 6, resilience was relatively low because the Shore D hardness was lowered so that the hitting feeling was more softened. However, the resilience in Examples 3, 5, and 6 was maintained at a satisfactory level. According to these facts, it is understood that when comparison is made for those having equivalent hardness, the golf ball of the present invention provides resilience higher than that of the golf ball having the cover composed of the mixture of the ionomer resin of sodium salt of ethylene-methacrylic acid copolymer, the ionomer resin of zinc salt of ethylene-methacrylic acid copolymer, and the ionomer resin of zinc salt of ethylene-acrylic acid ester-methacrylic acid terpolymer.

The wear mass was considerably minute, giving good wear resistance in Examples 1 to 6 as compared with Comparative Example 2 based on the use of the mixture composed of the ionomer resin (Himilan 1605) of sodium salt of ethylene-methacrylic acid copolymer, the ionomer resin (Himilan 1706) of zinc salt of ethylene-methacrylic acid copolymer, and the mixed resin (SA 420) comprising the sodium ion partially saponified resin of ethylene-ethyl acrylate copolymer. As a result of practical hitting, the cover surface scarcely suffered scratches.

The cover was hard, and the hitting feeling was inferior in Comparative Example 3, because the ionomer resin (A) was mixed in an excessive ratio, and the ionomer resin (B) was mixed in a smaller ratio. On the other hand, the cover was too soft, the resilience was deteriorated, and the hitting feeling was inferior in Comparative Example 4, because the ionomer resin (A) was mixed in a smaller ratio, and the ionomer resin (B) was mixed in an excessive ratio.

What is claimed is:

1. A golf ball comprising a core covered with a cover, wherein said cover is formed of a resin composition containing, as a major component, a mixture composed of (A) on ionomer resin of lithium salt of ethylene-(meth) acrylic acid copolymer, (B) an ionomer resin of bivalent metal salt of ethylene-(meth)acrylic ester-(meth)acrylic acid terpolymer, and (c) a partially saponified resin of ethylene-(meth)acrylic acid ester copolymer, wherein said partially saponified resin (C) of ethylene-(meth)acrylic acid ester copolymer is a product obtained with sodium, lithium, or potassium, and wherein based on 100% by weight said mixture, said resins are mixed in a ratio within a range of 10 to 75% by weight of said ionomer resin (A) of lithium salt of ethylene-(meth)acrylic acid copolymer, 10 to 88% by weight of said ionomer resin (B) of bivalent metal salt of ethylene-(meth)acrylic acid ester-(meth)acrylic acid terpolymer, and 2 to 30% by weight of said partially saponified resin (C) of ethylene-(meth)acrylic acid ester copolymer.

2. The golf ball according to claim 1, wherein said ionomer resin (A) of lithium salt of ethylene-(meth)acrylic acid copolymer has a content of (meth)acrylic acid of 10 to 25% by weight, a Shore D hardness of not less than 60, and a flexural rigidity of 300 to 500 MPa.

3. The golf ball according to claim 1, wherein said ionomer resin (B) of bivalent metal salt of ethylene-(meth) acrylic acid ester-(meth)acrylic acid terpolymer is an ionomer resin selected from the group consisting of an ionomer resin of zinc salt, an ionomer resin of magnesium salt, and an ionomer resin of calcium salt.

4. The golf ball according to claim 1, wherein said ionomer resin (B) of bivalent metal salt of ethylene-(meth) acrylic acid ester-(meth)acrylic acid terpolymer has a content of (meth)acrylic acid ester of 10 to 40% by weight, a content of (meth)acrylic acid of 2 to 20% by weight, a Shore D hardness of 20 to 50, and a flexural rigidity of 10 to 120 MPa.

5. The golf ball according to claim 1, wherein said partially saponified resin (C) of ethylene-(meth)acrylic acid ester copolymer has a content, of (meth)acrylic acid ester of 15 to 50% by weight, and a saponification degree of 5 to 50 mole %.

6. The golf ball according to claim 1, wherein assuming that said mixture is 100% by weight, said resins are mixed in a ratio within a range of 20 to 70% by weight said ionomer resin (A) of lithium salt of ethylene-(meth)acrylic acid copolymer, 20 to 78% by weight of said ionomer resin (B) of bivalent metal salt of ethylene-(meth)acrylic acid ester-(meth)acrylic acid terpolymer, and 2 to 25% by weight of said partially saponified resin (C) of ethylene-(meth)acrylic acid ester copolymer.

* * * * *